United States Patent [19]

Bleeker

[11] 4,043,625

[45] Aug. 23, 1977

[54] CAM SECURED SUPPORT PANEL

[75] Inventor: Raymond A. Bleeker, Grand Rapids, Mich.

[73] Assignee: Westinghouse Electric Corporation, Pittsburgh, Pa.

[21] Appl. No.: 661,459

[22] Filed: Feb. 26, 1976

[51] Int. Cl.[2] ..... A47B 88/00; F16M 11/26

[52] U.S. Cl. ..... 312/351; 312/253; 312/350; 312/311; 248/188.2

[58] Field of Search ..... 312/245, 311, 253, 350, 312/345, 351; 248/274, DIG. 7, 188.2–188.5; 211/134

[56] References Cited

U.S. PATENT DOCUMENTS

| | | | |
|---|---|---|---|
| 1,244,609 | 10/1917 | Hood et al. | 312/350 |
| 1,961,332 | 6/1934 | Burch et al. | 312/311 |
| 2,207,115 | 7/1940 | Carr | 211/134 |
| 2,281,769 | 5/1942 | Hochriem | 248/188.2 |
| 2,742,675 | 4/1956 | Robertson | 312/253 |
| 2,887,351 | 5/1959 | Allender | 312/253 |
| 2,967,079 | 1/1961 | Parvis | 312/274 |
| 3,271,092 | 9/1966 | Hatfield et al. | 312/311 |
| 3,452,878 | 7/1969 | Smith | 312/345 |
| 3,519,318 | 7/1970 | Hagen | 312/245 |
| 3,809,451 | 5/1974 | Pitstick | 312/351 |
| 3,822,085 | 7/1974 | Clark | 312/351 |
| 3,879,796 | 4/1975 | Whyte | 248/188.5 |
| 3,892,453 | 7/1975 | Daily | 312/311 |
| 3,946,979 | 3/1976 | Ehlebracht et al. | 312/245 |
| 3,952,905 | 4/1976 | Rumrill | 312/351 |

FOREIGN PATENT DOCUMENTS

| | | | |
|---|---|---|---|
| 1,249,403 | 1960 | France | 312/245 |

*Primary Examiner*—Paul R. Gilliam
*Assistant Examiner*—Victor N. Sakran
*Attorney, Agent, or Firm*—B. R. Studebaker

[57] ABSTRACT

A support panel for an inner cabinet storage system adapted to support a plurality of shelves, trays or the like within a larger storage cavity. The planar support panel is provided with a plurality of spaced horizontal slots on each face thereof for slidably receiving the shelves, trays or the like and includes at its top edge outwardly directed hook-shaped members which hang the panel from complementary ledges on the top wall of the storage cavity. The panel further includes a pair of spaced cam members which are journaled within the panel and extend through slots in the bottom of the panel. The cam members are rotatable to change the effective height of the panel and thereby secure the panel within the larger storage cavity.

4 Claims, 5 Drawing Figures

CAM SECURED SUPPORT PANEL

BACKGROUND OF THE INVENTION

Most wall-mounted or free-standing storage cabinets have a shelf height of at least 12 inches and with the exception of stacking magazines or storing large bulky items, at least half of the space between the shelves is generally vacant and constitutes a very inefficient use of the storage space. The ability to selectively compartmentalize this space to accommodate a specific storage problem is obviously desirable and will enhance the ability to efficiently utilize the entire space between the pair of spaced cabinet shelves. Many cabinet storage problems, as for example mail sorting, or the storage of computer readout paper, tapes, stationary, correpondence, books or looseleaf manuals, or even the storage of drafting tools and templets, pencils and paper clips, require only small, specifically defined areas for such storage and can be best accommodated where the storage area is compartmentalized.

Since office type storage of working materials and papers is in most cases a personal preference, any storage system should have a wide range of flexibility in order to accommodate the personal requirements of the user.

SUMMARY OF THE INVENTION

This invention relates to storage systems for compartmentalizing the interior of storage cabinets and the like, and more particularly is directed to a vertical support panel for supporting a plurality of shelves, trays, etc. within a larger storage cavity.

Since storage cabinets are not manufactured to precise tolerances, the height between shelves can vary to some degree. Additionally, loading of the shelves can also cause sufficient deflection to again affect the space or height between successive shelves.

One method for compartmentalizing the interior of a cabinet storage area is to provide the cabinet with a series of vertical partitions which are adapted to accommodate a plurality of shelves, trays and the like. To provide stability to such an inner cabinet storage system, some rigidity must be provided for the vertically disposed support panels.

In accordance with the present invention a rigid vertical support panel is provided in which the effective height of the panel can be changed slightly to accommodate differences in vertical storage space height due to variations in manufacturing tolerances and shelf loading. The support panel for supporting a plurality of shelves, trays or the like, within a larger storage cavity, in accordance with this invention, includes a planar panel member having a length substantially equivalent to the depth of the larger storage cavity and a height approximating the height of said cavity. The panel includes a plurality of horizontal slots in each of its faces which are adapted to receive a plurality of shelves, trays or the like. The panel further includes a pair of outwardly directed hook members adjacent the top edge of the panel which are adapted to cooperate with complementary ledges on the top wall of the cavity and further includes adjusting means in the form of rotatable cam members journaled within the panel and extending through an opening in the bottom edge thereof which are rotatable to vary the effective height of the panel and thereby secure the panel within the larger storage cavity.

BRIEF DESCRIPTION OF THE DRAWING

Many of the attendant advantages of the present invention will become more readily apparent and better understood as the following detailed description is considered in connection with the accompanying drawing, in which.

DESCRIPTION OF THE PREFERRED EMBODIMENT

Figure 1:
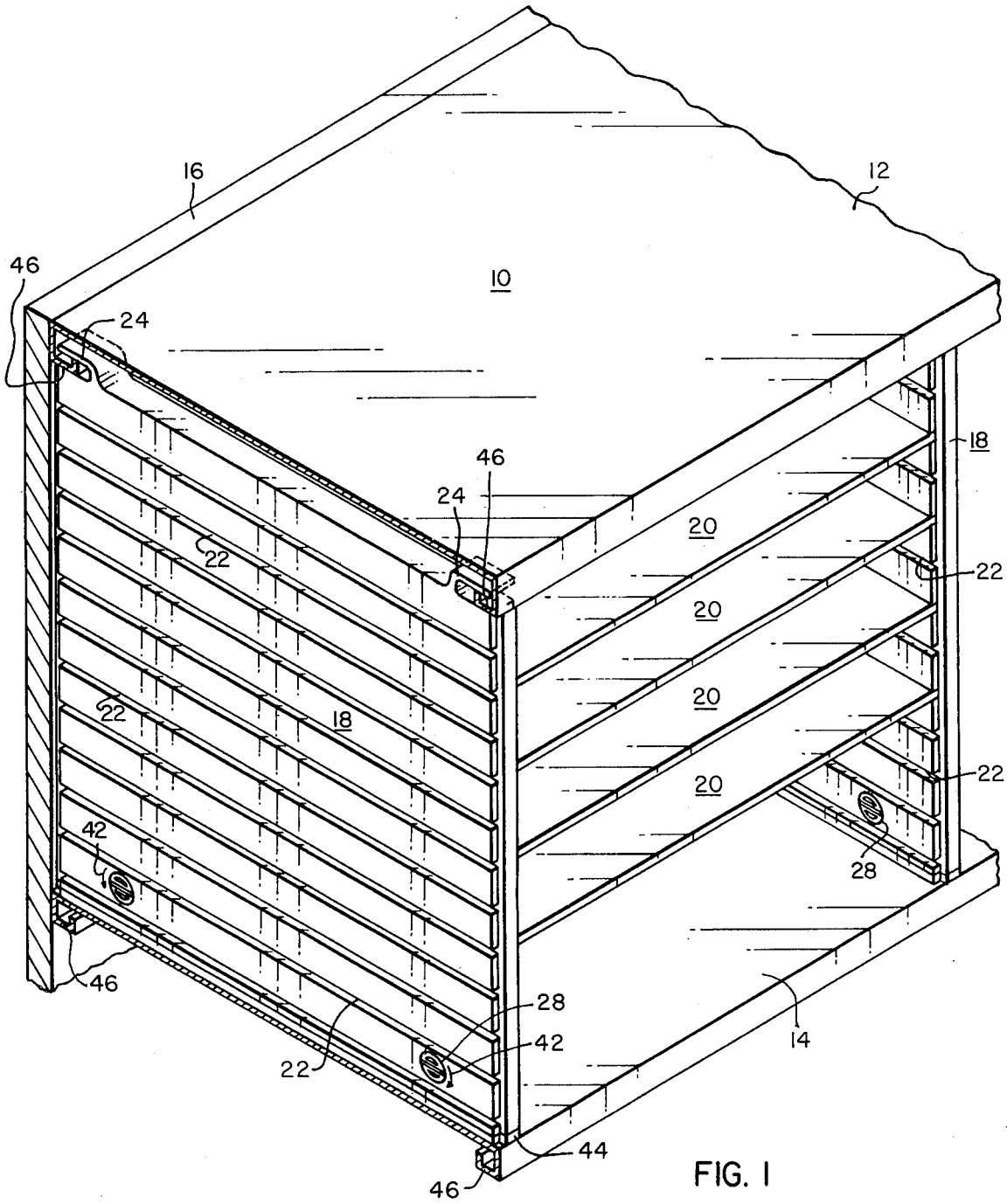
FIG. 1 is an isometric view, partly in section, of a portion of a storage cabinet employing the support panel of this invention.

Referring now in detail to the drawing, wherein like reference characters represent like parts throughout the several views, there is illustrated in FIG. 1 a portion of a storage cabinet generally designated 10 which includes upper and lower shelves 12 and 14 respectively. As illustrated the cabinet includes a back wall 16 which may or may not be included as a part of the storage cabinet. In this regard, many wall-mounted cabinets do not include a back wall and the member 16 could equally be a wall panel of the free-standing movable type or a fixed room wall. It will also be apparent that the cabinet 10 could include several shelves to define a plurality of storage cavities or could in fact be a cabinet which includes only a single storage cavity in which case the shelves 12 and 14 would also represent the top and bottom walls of the cabinet.

The subject matter of this invention is limited to a support panel of the type generally designated 18. The panel 18 is not a side wall of the cabinet but rather is a vertical partition which serves to divide the larger storage cavity defined by the cabinet's side walls and shelves into smaller more efficient storage spaces. The vertical panel 18 serves two functions, one to divide the larger storage space or cavity into vertical sections and also to provide support for shelves, trays or the like which horizontally further divide the storage space between the vertical support panels 18. Such horizontal dividing members such as trays, shelves or the like, are generally designated 20. The support panel 18 of this invention is generally planar and has a length substantially equivalent to the depth of the larger storage cavity it is intended to subdivide and also has a height which is approximately the height of that cavity. Each of the planar faces of the support panel 18 are provided with a plurality of equidistantly spaced horizontal slots 22 therein for supporting the shelves, trays or the like 20. The panels 18 are also provided with outwardly directed hook-shaped members 24 on their upper edge adjacent each side edge of the panel.

The height adjusting mechanisms are provided at the bottom end of the panel and include a pair of cam discs which are mounted for rotation within the panel body. As best seen in FIGS. 2 through 5, a pair of spaced slots or openings 26 are provided in the bottom edge of the panel which communicate with a space between the planar panel surfaces. A pair of circular apertures 28 in each face of the planar panel also communicate with this space and are constructed and arranged to receive the cylindrical hubs 30 of the disc-shaped cam members 32. The rotatable cam disc is mounted in the space between the planar faces of the panel with the hubs extending through those faces. The cam disc 32 is provided with a plurality of flat surfaces extending about the edge thereof with each of the flat surfaces being sequentially spaced from the center of the cam disc a greater radial distance. The panel 18 is preferably manufactured in two halves of ABS plastic which are identical and are then secured together by a suitable solvent weld to fix the assembly after the hubs 30 have been properly positioned in the apertures 28 in each of the side walls or planar faces of the panel.

Figure 2:
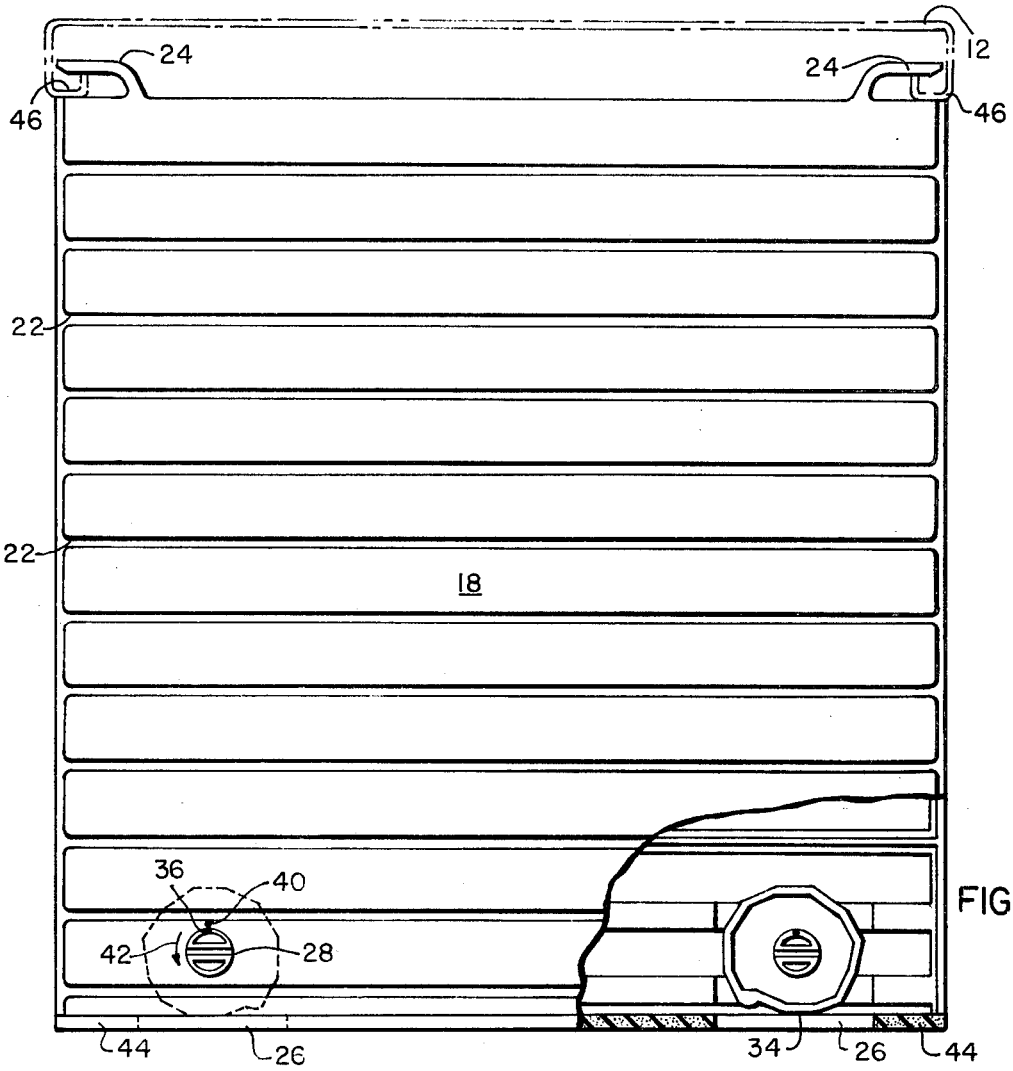
FIG. 2 is a side elevational view, partly in section, of a support panel constructed in accordance with this invention.
Figure 3:
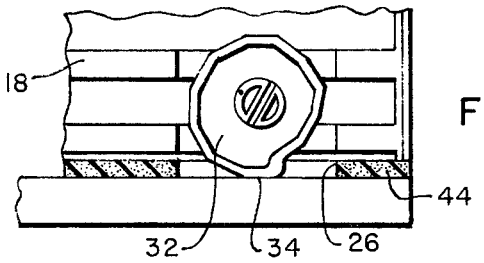
FIG. 3 is a side elevational view of a panel corner illustrating the cam in a different position.
Figure 5:
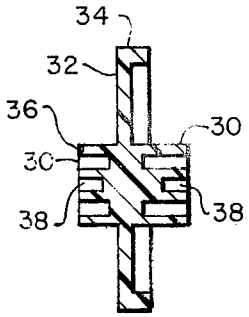
FIG. 5 is a sectional view taken along the line V—V of FIG. 4.
Figure 4:
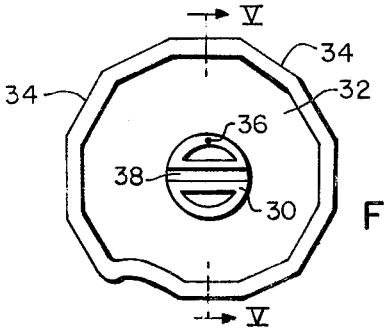
FIG. 4 is a side elevational view of the cam member of this invention.

Molded into the outer edge of the hubs 30 is a depression or dot 36 and a key slot 38. A dot or depression 40, similar to the dot or depression 36, is also molded into the planar face of the panel 18 adjacent and above the circular apertures 28. When the dots or depressions 36 and 40 are aligned as illustrated in FIG. 2, the flat 34 on the cam discs 32 having the smallest radial distance from the center of the cam is located in the slots 26. An arrow indicator 42 is also molded into the planar panel face and indicates the direction in which the cam disc 32 should be rotated by means of a coin or screwdriver in the slots 38 to progressively present a flat 34 of increasing radial dimension at the slot 26. FIG. 3 illustrates the position of right-hand cam disc when the flat 34 having the greatest radial dimension is presented to the slot 26.

The bottom edge of the panel 18 may also be provided with a foam strip 44 which may be sufficient to fill the gap where the tolerances are close.

In operation, to mount the support panel 18 in a larger storage cabinet, the outwardly directed hook-shaped members 24 are interconnected with complementary ledges or flanges 46 on the underside of the upper shelf or cabinet top, and the panel is then rotated into a vertical position. At this point the problem occurs, not all cabinet inside height spacing is alike due to differences in manufacturing tolerances and in some cases shelf loading. For this reason, the bottom edge of the support panel is in many cases, hanging in the air above the bottom shelf. If the support panel is to be rigid at both the top and bottom to act as a gap filler and provide a bearing surface for the panel which will carry a plurality of shelves, trays or the like 20, the gap or space between the bottom end of the panel and the lower shelf must be filled. In some instances, the foam strip 44 will close this gap and provide support for the panel. Should the foam strip 44 not provide the rigidity necessary because of the original manufacturing tolerances or because of deflection of the lower shelf through loading, the cam 32 which is preset at the "0" level with the dots 40 and 36 corresponding can be "dialed" or rotated until one of the flats 34 on the cam disc 32 provides the rigidity to the support panel which is necessary.

As will be apparent from the foregoing, the pair of cam members 32 in the bottom of the support panel can be rotated to change the effective height of the panel and thereby secure the panel within a larger storage cabinet to provide vertical support to an inner cabinet storage system involving a plurality of shelves, trays or the like to effectively and efficiently compartmentalize a larger storage cavity.

What is claimed is:

1. A support panel for supporting a plurality of shelves, trays or the like within a larger storage cavity, said support panel comprising:

a planar panel member having a length substantially equivalent to the depth of said cavity and a height approximately the height of said cavity, said panel including a plurality of horizontal slots in at least one side thereof adapted to receive said plurality of shelves, trays or the like;

means adjacent the top edge of said panel for supporting said panel within said cavity; and adjusting means associated with the bottom edge of said panel, said adjusting means including a pair of cam discs having a series of flat surfaces of progressively greater radial dimension from the center of said cam disc, journaled within said panel and extending through an opening in the bottom edge thereof, said cam discs adapted for rotation within said panel to thereby change the effective height of said panel.

2. The support panel according to claim 1 wherein said means adjacent the top edge of said panel for supporting said panel within said cavity is a pair of outwardly directed hook members adapted to cooperate with a complementary ledge on the top wall of said cavity.

3. A support panel for supporting a plurality of shelves, trays or the like within a larger storage cavity, said support panel comprising:

a planar panel member having planar faces on each side and a length substantially equivalent to the depth of said cavity and a height approximating the height of said cavity, said panel including a pair of spaced spaces between its planar faces communicating with openings in the bottom edge of said panel, a pair of circular apertures in each planar face communicating with each of said spaced spaces, and a plurality of horizontal slots in each of said planar faces;

means adjacent the top edge of said panel for supporting said panel within said cavity; and a pair of cam discs having a plurality of flat surfaces on the radial edge thereof with each of said flat surfaces being sequentially a greater distance from the center of said cam disc, said cam discs further including laterally extending hubs thereon, said hubs being journaled for rotation in said circular apertures in said planar panel to thereby mount said cam discs for rotation within said spaced spaces, said cam discs constructed and arranged to extend through said openings in the bottom of said panel to thereby vary the height of said panel.

4. The support panel according to claim 3 wherein said means adjacent the top edge of said panel are a pair of outwardly directed hook-shaped members extending from the top edge of said panel adjacent each side edge thereof.

* * * * *